US010384257B2

(12) United States Patent
Greenleaf

(10) Patent No.: US 10,384,257 B2
(45) Date of Patent: Aug. 20, 2019

(54) KEEPER PLATE ALIGNMENT ARRANGEMENT FOR PUNCH PRESS

(71) Applicant: Don Halgren, Manchester, MA (US)

(72) Inventor: Richard J. Greenleaf, Manchester, MA (US)

( * ) Notice: Subject to any disclaimer, the term of this patent is extended or adjusted under 35 U.S.C. 154(b) by 196 days.

(21) Appl. No.: 15/731,317

(22) Filed: May 24, 2017

(65) Prior Publication Data

US 2017/0259321 A1 Sep. 14, 2017

Related U.S. Application Data

(63) Continuation-in-part of application No. 15/530,236, filed on Dec. 14, 2016, now Pat. No. 10,201,906, which is a continuation-in-part of application No. 14/544,416, filed on Jan. 2, 2015, now Pat. No. 9,561,534.

(51) Int. Cl.

| | |
|---|---|
| ***B21D 37/04*** | (2006.01) |
| ***B26F 1/14*** | (2006.01) |
| ***B21D 28/34*** | (2006.01) |
| ***B26D 7/26*** | (2006.01) |
| ***B26F 1/38*** | (2006.01) |

(Continued)

(52) U.S. Cl.

CPC ..... *B21D 37/04* (2013.01); *B21D 28/34* (2013.01); *B26D 7/26* (2013.01); *B26D 7/2628* (2013.01); *B26F 1/14* (2013.01); *B26F 1/3846* (2013.01); *B26F 1/40* (2013.01); *B26F 1/44* (2013.01); *Y10T 83/9423* (2015.04)

(58) Field of Classification Search

CPC ..... B21D 37/02; B21D 37/04; B21D 37/06; B21D 28/34; B26F 1/14; B26F 1/40; Y10T 83/9425; Y10T 83/9423; Y10T 83/9473; Y10T 83/9428; Y10T 83/9437

See application file for complete search history.

(56) References Cited

U.S. PATENT DOCUMENTS 1,008,115 A * 11/1911 Clark ..... B21D 37/04 269/235
2,364,834 A * 12/1944 Whistler ..... B26D 7/2614 83/685
3,982,458 A * 9/1976 Terasaka ..... B21D 37/04 83/685

FOREIGN PATENT DOCUMENTS

DE 468473 C * 11/1928 ..... B21D 37/04

OTHER PUBLICATIONS

English Translation DE468473. (Year: 1928).*

* cited by examiner

*Primary Examiner* — Jennifer B Swinney
(74) *Attorney, Agent, or Firm* — Don Halgren

(57) ABSTRACT

A punch press quick tool change system comprising a reciprocally movable upper support member arranged on a punch press frame. The system also includes a lower support member arranged on the punch press frame. A pair of tool gripping members are arranged on the upper support member and also on the lower support member. The tool gripping members comprises a 1$^{st}$ pair of spaced-apart parallel keeper positioners secured to the upper support member for securing the tool gripping arrangement plate adjustably against the upper support member. A 2$^{nd}$ pair of parallel keeper positioners are secured to the lower support member for securing a 2$^{nd}$ tool gripping plate adjustably against the lower support member.

10 Claims, 4 Drawing Sheets

(51) Int. Cl.
*B26F 1/40* (2006.01)
*B26F 1/44* (2006.01)

KEEPER PLATE ALIGNMENT ARRANGEMENT FOR PUNCH PRESS

BACKGROUND OF THE INVENTION

Field of the Invention

This invention relates to punch press assemblies and more particularly to a keeper plate arrangement to enable quick set-up and alignment of both or either a center punch holder plate on an upper portion of the punch press and an opposed die plate on a lower portion of the punch press, to permit very quickly changed, accurate alignment arrangements to facilitate the alignment of opposing tools utilized to pierce a sheet of material such as for example in a punch press, and is a continuation-in-part of application Ser. No. 15/530,236, filed Dec. 14, 2016 which is a continuation-in-part of application Ser. No. 14/544,416, filed Jan. 2, 2015, now U.S. Pat. No. 9,561,534, issued on Feb. 7, 2015, which is a continuation of application Ser. No. 12/924,139, filed Sep. 21, 2010, now U.S. Pat. No. 8,925,435, which was a co-pending application of application Ser. No. 12/214,924 filed Jun. 24, 2008 and application Ser. No. 11/450,526 filed Jun. 9, 2006, each incorporated herein by reference in their entirety.

Discussion of the Prior Art

Compound tooling is currently utilized by hundreds of manufacturers to produce thousands of different types of washers made from aluminum, brass, copper, nylon, steel utilized in almost everything society touches. Washers are for example, utilized in any product with nuts and bolts or moving parts. The inside diameter and the outside diameter of these washers or other punched parts have become more critical and significant for use in the manufacture of high-quality precision devices.

Prior art tool and die sets arrangements require as much as several hours to change a punch tool and a die tool. Such procedures may comprise removal of the die from the press, washing the die, take out the dowels and screws, surface grind the punches and dies, re-assemble and re-install all into the punch press. Accuracy of alignment between the punch and die is critical to an effective punch press operation. However, too much time in set up and tool change damages productivity and plant efficiency.

It is an object of the present invention to overcome the disadvantages of the prior art.

It is a further object of the present invention to provide a tool set in which the punch and die members are quickly and easily changed with different sets of tools while permitting their accurate re-alignment.

BRIEF SUMMARY OF THE INVENTION

The present invention comprises a tool holder arrangement for the manufacture of punched parts in a punch press assembly, from a traveling web or sheet of material such as metal or plastic to produce washers or the like, as recited in my aforementioned U.S. Pat. Nos. 8,925,435 and 9,561,534, each of which are incorporated hereinabove by reference.

The die set assembly or arrangement of the present invention comprises a compound punch holder plate which would be bolted to the underside of the die shoe of a punch press.

A die set arrangement typically comprises an upper support portion which comprises the upper punch holder plate. The upper punch holder plate is disposed parallel to and reciprocably movable with respect to the stripper holderplate on the base portion of the die set arrangement. The punch holder plate is supported on guide pins which are received in guide bushings at their lowermost end. A center punch holder plate is secured to the lower side of the punch holder plate. The center punch holder plate has a bore which adjustably arranged about a center punch there within. A die holder plate is supported by those same pins onto the lower side of the center punch holder plate. The die holder plate has a central opening of a third diameter. The opening in the die holder plate is arranged to adjustably enclose and align a die member therewithin. The die holder plate has a central opening which encloses an annular knockout member. The annular knockout member has a central bore through which the center punch, supported at its upper end by the center punch holder plate, is supported.

Reciprocating motion of the upper portion of the die set arrangement, with its die arranged downwardly therefrom, impacting the stripper holder plate supported on the lower portion of the die set arrangement, with a traveling web of material moving therebetween, effects the manufacture of a punched part by virtue of the center punch and the die mating with the compound punch and its associated stripper holder.

The concentric alignment each of these components is critical to the manufacture of a proper punched part.

The center punch holder plate and the die holder plate in the uppermost portion of the die set arrangement, and the stripper holder plate and the compound punch holder plate in the lower portion of the die set arrangement, are each held in their respective uppermost portions and lowermost portions of the punch press assembly by an arrangement of keeper positioners.

The keeper positioners are fixedly attached to the respective upper and lower support plates and are arranged at opposite sides of the punch holder plate and the die holder plate. For ease of description only the keeper positioner arrangement for the (upper) punch holder will be described although the structure will be similar for the support of the die holder plate.

The $1^{st}$ keeper positioner is an elongated member of length preferably equivalent to the width of the punch holder plate, and is arranged to securely engage a $1^{st}$ side of that punch holder plate. The $2^{nd}$ keeper positioner is an elongated member of length preferably equivalent to the width of the punch holder plate and is arranged to adjustably secure and engage a $2^{nd}$ side of that punch holder plate, that $2^{nd}$ keeper positioner side being parallel to the $1^{st}$ side of the punch holder plate.

The $1^{st}$ keeper positioner has a plurality of bores extending therethrough to permit the aligned bolted securement of that $1^{st}$ keeper positioner against its support plate thereabove. The $1^{st}$ keeper positioner has a feature-enhanced elongated side edge which is arranged at a slant or angle with respect to its face surfaces. The elongated angled side edge of the $1^{st}$ keeper positioner also has a plurality of feature enhancing alignment protrusions thereon. The $1^{st}$ side of the punch holder plate, the placement of which comes into abutting engagement whether the feature-enhanced elongated side edge, has a corresponding plurality of feature-enhanced receiving portions thereon. The $1^{st}$ side of the punch holder plate is also arranged at a reciprocal angle with respect to the angled side edge of the $1^{st}$ keeper positioner and also to its to its face surfaces.

The $2^{nd}$ keeper positioner has a plurality of bores extending therethrough so as to permit threaded engagement with the support plate to which it is to be attached. The $2^{nd}$ keeper positioner has a plurality of generally "J" shaped cutouts which are each arranged to enclose a generally "J" shaped flexible finger pivotably movable therein. Each "J" shaped flexible finger has a distal end of curvilinear shape with a face thereon arranged at an angle with respect to the plane of its face.

The $2^{nd}$ side of the punch (tool) holder plate has a corresponding curvilinear detent thereon to match the curvilinear shape and slanted face of the respected flexible fingers extending from a side portion of the $2^{nd}$ keeper positioner. The $2^{nd}$ keeper positioner also has a threaded bore extending through a side edge thereof so as to permit a threaded bias by a setscrew arranged therein against the respective "J" shaped flexible fingers so as to press them against the $2^{nd}$ elongated edge of the punch holder plate.

This arrangement of reciprocally angled sides between the Pt keeper positioner and the $1^{st}$ elongated side of the punch holder plate and the reciprocally angled sides between the $2^{nd}$ keeper positioner and its pivotable fingers and the $2^{nd}$ side of the punch holder plate permit fast and easy slidable exchange of the punches and respective punch holder plates during the need for changing same in a punch press assembly operation by adjustably backing off the "J" shaped fingers from slanted biased engagement with the tool holder plate. A corresponding arrangement of engagement members and the side edges for keeper positioners to be utilized with the die set holderplate further facilitates the ease of manufacturing of products thereby.

The invention thus comprises punch press quick tool change system comprising: a reciprocally movable upper support member arranged on a punch press frame; a lower support member arranged on the punch press frame; a tool gripping arrangement plate arranged on the upper support member and on the lower support member; a $1^{st}$ pair of parallel keeper positioners secured to the upper support member for securing the tool gripping arrangement plate adjustably thereagainst; and a $2^{nd}$ pair of parallel keeper positioners secured to the lower support member for securing a tool gripping arrangement plate adjustably thereagainst. The $1^{st}$ pair of keeper positioners each have a tool support plate engaging side edge. The tool support plate engaging side edge of the keeper positioners have enhanced bump-out surfaces thereon. A $1^{st}$ keeper positioner of the $1^{st}$ pair of keeper, positioners has an inclined plate-engaging $1^{st}$ edge. A $2^{nd}$ keeper positioner of the $1^{st}$ pair of keeper positioners has a pair of biasable "J" shaped fingers arranged therein. The pair of biasable "J" shaped fingers have a sloped distalmost surface.

The invention also comprises a tool plate quick securement arrangement for a punch press apparatus for respectively securing slidably loadable/unloadable complimentarily configured tool support plates, the securement arrangement comprising: a pair of parallel keeper positioners secured to an upper support plate of the punch press apparatus; a pair of parallel keeper positioners secured to a lower support plate of the punch press apparatus; a pair of pivotably biasable "J" shaped fingers extending from one side of a first one of each pair of keeper positioners, the "J" shaped fingers being arranged to adjustably and biasedly engage a complimentarily configured tool support plate thereadjacent and between a $2^{nd}$ one of each pair of keeper positioners, and wherein a slanted curvilinear engagement slot is arranged on a $2^{nd}$ side edge of each tool support plate for enabling aligned engagement and securement thereof, with respect to an adjacent pivotable biasable "J" shaped finger biasably extending therefrom. The complimentarily configured tool support plate has a $1^{st}$ side edge arranged at an angle with respect to a planar surface of the tool support plate, the $1^{st}$ side edge having a protrusion receiving arrangement thereon. The keeper positioner engageable with the $1^{st}$ side edge of the tool support plate has a correspondingly complimentarily angled engagement edge thereon. Each "J" shaped finger is supported in a "J" shaped enclosure slot in their respective keeper positioners. A pressure pad is arranged within the "J" shaped enclosure slot between "J" shaped finger and a wall defining the "J" shaped slot. A threaded adjustment member is arranged through the keeper positioner enclosing a "J" shaped finger, and into abuttable adjustable engagement with the "J" shaped finger therewithin.

The invention thus also comprises a punch press quick tool change system comprising a reciprocally movable upper support member arranged on a punch press frame. The system also includes a lower support member arranged on the punch press frame. A pair of tool gripping members are arranged on the upper support member and also on the lower support member. The tool gripping members comprises a $1^{st}$ pair of spaced-apart parallel keeper positioners secured to the upper support member for securing the tool gripping arrangement plate adjustably against the upper support member. A $2^{nd}$ pair of parallel keeper positioners are secured to the lower support member for securing a $2^{nd}$ tool gripping plate adjustably against the lower support member.

BRIEF DESCRIPTION OF THE DRAWINGS

The objects and advantages of the present invention will become more apparent when viewed in conjunction with the following drawings, in which:

FIG. 5B is a view taken along line the lines 5B-5B of FIG. 5A;

DETAILED DESCRIPTION OF THE PREFERRED EMBODIMENTS

Figure 1:
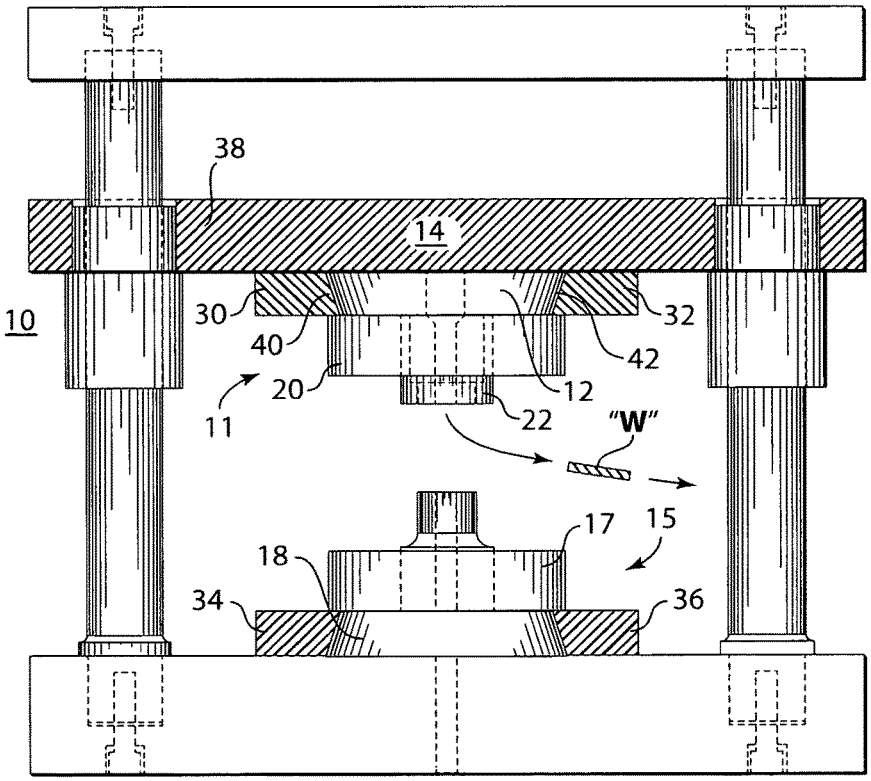
FIG. 1 is a side elevational view of a punch press assembly constructed according to the principles of the present invention.
Figure 8:
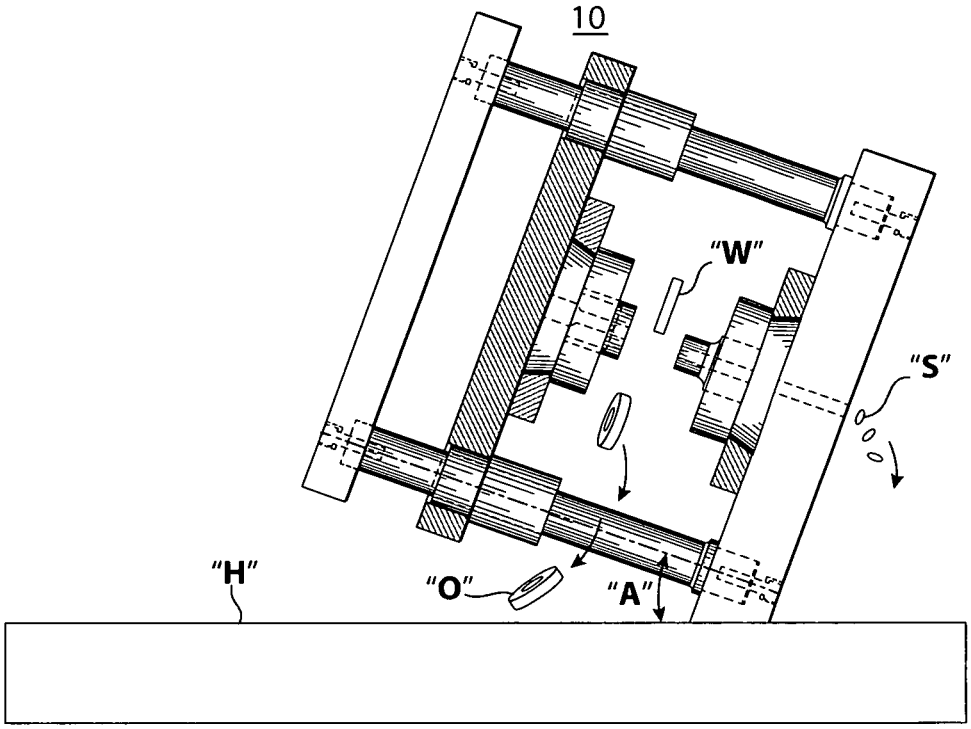
FIG. 8 is a side elevational view of the punch assembly represented in FIG. 1, in an operational (slanted, non-vertical) orientation.

Referring now to the drawings in detail and particularly to FIG. 1 there is shown the present invention in which comprises a tool holder arrangement for the manufacture of punched parts in a punch press assembly 16, from a traveling web or sheet of material "W" such as metal or plastic, as represented in FIG. 8, to produce washers or the like, as recited in my aforementioned U.S. Pat. Nos. 8,925,435 and 9,561,534, each of which are incorporated hereinabove by reference.

The die set assembly or arrangement 10 of the present invention comprises a compound punch holder plate 12 (which would in the prior art, normally be bolted to the underside of the die shoe 14 of the punch press 16), herein shown attached to shoe 14, by the present invention, as may in be represented in FIG. 1.

A die set arrangement 10 typically comprises an upper portion 11 which comprises the upper punch holder plate 12. The upper punch holder plate 12 is disposed parallel to and reciprocably movable with respect to the compound holder punch tool support plate 18 on the base portion 15 of the die set arrangement 10, as represented in FIG. 1. The punch holder plate 12 is supported on guide pins which are received in guide bushings at their lowermost end, as described in my referenced U.S. Pat. No. 8,925,435. A center punch holder plate 20 is secured to the lower side of the punch holder plate 12. The center punch holder plate 20 has a bore which is adjustably arranged about a die 22 therewithin. Reciprocating motion of the upper portion "U" of the die set arrangement, with its die arranged downwardly therefrom, impacting the stripper holder plate supported on the lower portion of the die set arrangement, with a traveling web of material "W" moving therebetween, effects the manufacture of a punched part by virtue of the center punch and the die mating with the compound punch and its associated stripper holder, as recited in my '435 Patent.

The concentric alignment each of these components is critical to the manufacture of a proper punched part.

Figure 7:
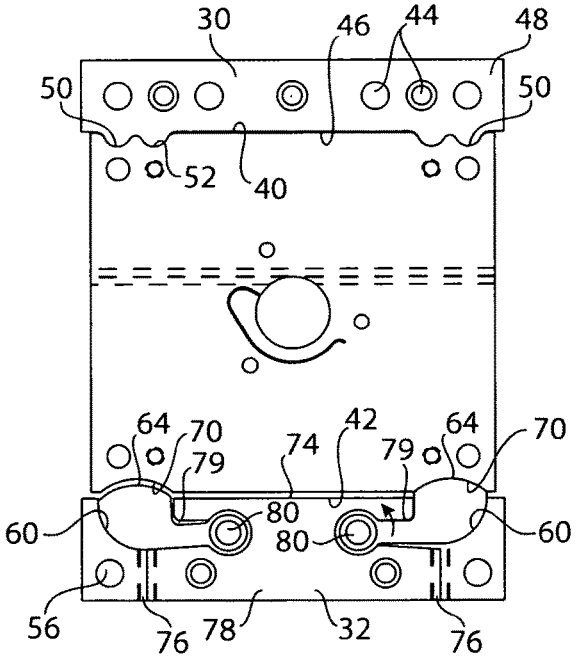
FIG. 7 is a plan view of the punch holder plate arranged securely between the $1^{st}$ keeper positioner and the $2^{nd}$ keeper positioner.

The center punch holder plate 12 and the die holder plate 20 in the uppermost portion "U" of the die set arrangement 10, and the stripper holder plate 17 and the compound punch holder plate 18 in the lower portion 15 of the die set arrangement 10, are each held in their respective uppermost portions and lowermost portions of the punch press assembly by an arrangement of keeper positioners 30, 32, 34 and 36 respectively, as represented in FIGS. 1 and 7, only one set keeper positioners (the upper set, 30 and 32) will be described for purposes of clarity, inasmuch as they are similar to one another.

Figure 2:
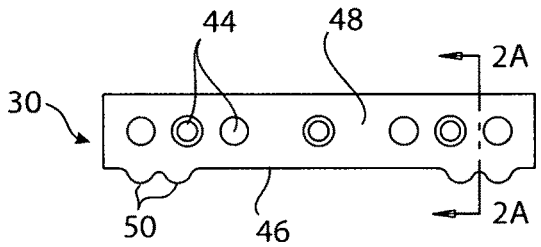
FIG. 2 is a plan view of the $1^{st}$ keeper positioner showing the through openings and side enhancements according to the principles of the present invention.
Figure 2A:
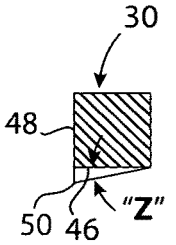
FIG. 2A is a view taken along the lines 2A-2A in FIG. 1.
Figure 6:
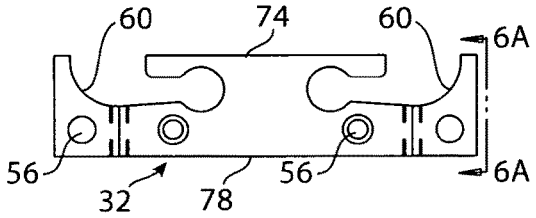
FIG. 6 is a plan view of the $2^{nd}$ keeper positioner.
Figure 6A:
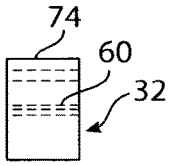
FIG. 6A is a view taken along the lines 6A-6A of FIG. 6.

The (upper) $1^{st}$ and $2^{nd}$ keeper positioners 30 and 32, shown in edge view in FIG. 1, and in plan view shown respectively in FIGS. 2 and 6, are fixedly attached to the upper support plate 38 and are arranged at opposite sides of the punch holder plate 12. For ease of description only the keeper positioner arrangement 30 and 32 for the punch holder plate 12 will be described although the structure will be similar for the support of the compound holder punch plate. The $1^{st}$ keeper positioner 30, shown in a plan view in FIG. 2 is an elongated member of length preferably equivalent to the width of the punch holder plate 12 as may be seen in FIG. 7, and is arranged to securely engage a $2^{nd}$ side 40 of that punch holder plate 12. The $2^{nd}$ keeper positioner 32 is also an elongated member of length preferably equivalent to the width of the punch holder plate 12 and is arranged to adjustably secure and engage a $1^{st}$ side of 42 that punch holder plate 12, that $1^{st}$ side 42 being parallel to the $2^{nd}$ side 40 of the punch holder plate 12.

Figure 3:
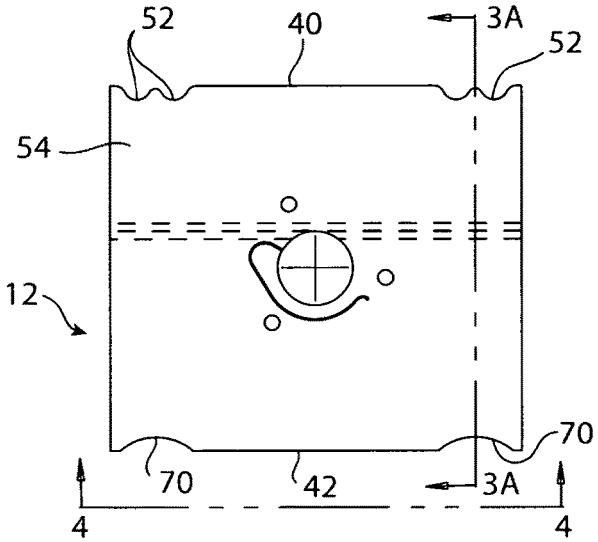
FIG. 3 is a plan view of the punch holder plate.
Figure 3A:
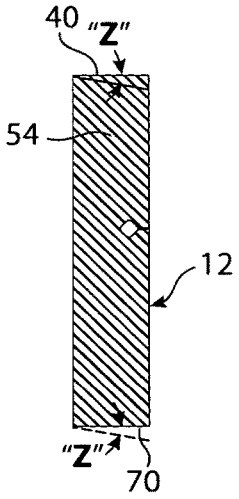
FIG. 3A is a view taken along the lines 3A-3A in FIG. 3.

The $1^{st}$ keeper positioner 30 has a plurality of bores 44 extending therethrough to permit the aligned bolted securement of that $1^{st}$ keeper positioner 30 against its support plate 38 thereabove, as shown in FIG. 1. The $1^{st}$ keeper positioner 30 has a feature-enhanced elongated side edge 46 the surface of which is arranged at a slight angle "Z" (preferably between 15 and 30 degrees) with respect to its face surface 48. The elongated slanted or angled side edge 46 of the $1^{st}$ keeper positioner 30 also has a plurality of "bump-out" feature-enhancing alignment protrusions 50 thereon. The $2^{nd}$ side 40 of the punch holder plate 12, the placement of which comes into abutting engagement with the feature enhanced elongated side edge 46 of the $1^{st}$ keeper positioner 30, which has a corresponding plurality of feature-enhanced-receiving-portions 52 thereon, as represented in FIG. 3. The $2^{nd}$ side 40 of the punch holder plate 12 is also arranged at a reciprocal (complementary) angle "Z" with respect to the angled side edge 46 of the $1^{st}$ keeper positioner 30 and also to its to its face surfaces 54.

Figure 5:
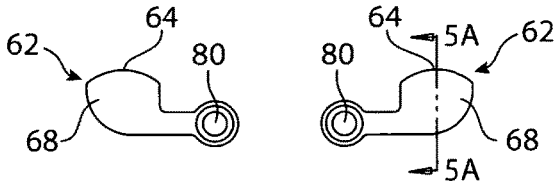
FIG. 5 is a plan view of one of the articulable fingers utilized in conjunction with the $2^{nd}$ keeper positioner.
Figure 5A:
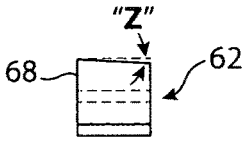
FIG. 5A is a plan view of the other articulable finger utilized in conjunction with the $2^{nd}$ keeper positioner.

The $2^{nd}$ keeper positioner 32, shown in FIGS. 6 and 7, has a plurality of bores 56 extending therethrough so as to permit threaded engagement with the support plate 38 to which it is to be attached, as represented in FIGS. 1 and 8. The $2^{nd}$ keeper positioner 32 has a plurality of generally "J" shaped cutouts 60 shown in FIGS. 6 and 7, which are each arranged to pivotably enclose a generally "J" shaped flexible finger 62, (see FIGS. 5 and 5A) pivotably movable therein about an axis 80, as represented in FIG. 7. Each "J" shaped flexible finger 62 has a distal end 64 of curvilinear shape, as may be seen in FIGS. 5, 5A and FIG. 7, with a face 67 thereon arranged at an sloped angle "Z" with respect to the plane of its face 68, as represented in FIG. 5B.

Figure 4:
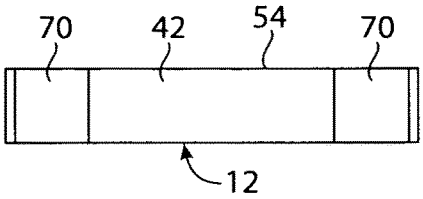
FIG. 4 is a view taken along the lines 4-4 in FIG. 3.

The $1^{st}$ side 42 of the punch holder plate 12 has corresponding slanted, curvilinear detents 70 thereon, as represented in FIGS. 3, 4 and 7, to match the plate-retaining slanted curvilinear shape 64 and snugly engage the slanted faces 64 of the respective flexible fingers 62 biasedly extendable from a side portion 74 of the $2^{nd}$ keeper positioner 32, as may be seen as "detent-engaged" in the lower right hand side of FIG. 7, with a setscrew (not shown for clarity) thus facilitating the quick change keeping and alignment of the plates (i.e. 12) with the die set arrangement 10. The $2^{nd}$ keeper positioner 32 also has a threaded bore 76 extending through a side edge 78 thereof, as shown in FIGS. 6 and 7, so as to permit a threaded bias against a rubber pressure pad 79 arranged between the walls of the "J" shaped cutout 60, and a side edge of each "J" shaped finger 62, such bias adjustable by a setscrew arranged therein (not shown for clarity of the drawings) against the respective flexible fingers 62, so as to press them against the $1^{st}$ elongated edge 42 of the punch holder plate 12, as represented in FIG. 7.

This arrangement of reciprocally angled sides 46 between the Pt keeper positioner 30 and the $2^{nd}$ elongated side 40 of the punch holder plate 12 and the reciprocally angled sides 42 between the $2^{nd}$ keeper positioner 32 and its pivotable fingers 62 and the detents 70 in the $1^{st}$ side 42 of the punch holder plate 12 permit fast and easy slidable removable exchange of the punches and respective punch holder plates during the need for changing same in a punch press assembly operation.

A corresponding arrangement of engagement members and the side edges for keeper positioners to be utilized with the lower holder plate set not specifically described but common to that described hereinabove, further facilitates the ease of manufacturing of punched out products "P", represented in FIG. 8, thereby. The die set arrangement 10 shown in FIG. 8 is arranged at an angle "A" of about 30 degrees with respect to the horizontal "H" to permit pressed/stamped-out washers "O" for example, to fall away and slugs or center holes "S" to fall clear without clogging up the punch press operation.

I claim:

1. A punch press quick tool change system comprising:

a reciprocally movable upper support plate member arranged on a punch press frame;

a lower support plate member arranged on the punch press frame; a tool gripping arrangement holder plate arranged on both the upper support plate member and on the lower support plate member;

a 1st pair of parallel keeper positioners secured to the upper support plate member for securing the tool gripping arrangement holder plate adjustably thereagainst; and a 2nd pair of parallel keeper positioners secured to the lower support plate member for securing a tool gripping arrangement plate adjustably thereagainst; and wherein at least one keeper positioner of each of the 1st and 2nd pairs of keeper positioners has a pair of biasable generally "J" shaped fingers arranged in a generally "J" shaped slot of the respective keeper positioner, and the fingers are pivotable outwardly therefrom, so as to enable a mating engagement with a corresponding pair of detents arranged in only one side of the respective holder plate adjacent to the keeper positioner.

2. The punch press quick tool change system as recited in claim 1 wherein the $1^{st}$ pair of keeper positioners each have a tool support plate engaging side edge.

3. The punch press quick tool change system as recited in claim 2 wherein the tool support plate engaging side edge of the keeper positioners have enhanced bump-out surfaces thereon.

4. The punch press quick tool change system as recited in claim 2, wherein a $1^{st}$ keeper positioner of the support plate engaging side edge of the $1^{st}$ pair of keeper positioners is an inclined plate-engaging $1^{st}$ edge arranged to align with a corresponding inclined edge on an adjacent holder plate.

5. A tool plate quick securement arrangement for a punch press apparatus for respectively securing slidably loadable/unloadable complimentarily configured tool support plates, the securement arrangement comprising:

a pair of parallel keeper positioners secured to an upper support plate of the punch press apparatus;

a pair of parallel keeper positioners secured to a lower support plate of the punch press apparatus;

a pair of pivotably biasable generally "J" shaped fingers extending from one side of a first one of each pair of keeper positioners, the generally "J" shaped fingers being arranged to adjustably and biasedly engage a complimentarily configured tool support plate thereadjacent and between a $2^{nd}$ one of each pair of keeper positioners, and wherein a slanted curvilinear engagement slot is arranged on a 2nd side edge of each tool support plate for enabling aligned engagement and securement thereof, with respect to an adjacent pivotable biasable generally "J" shaped finger biasably extending therefrom.

6. The tool plate quick securement arrangement for a punch press as recited in claim 5, wherein the complimentarily configured tool support plate has a 1st side edge arranged at an angle with respect to a planar surface of the tool support plate, the 1st side edge having a protrusion receiving arrangement thereon.

7. The tool plate quick securement arrangement for the punch press as recited in claim 6 wherein the keeper positioner engageable with the 1st side edge of the tool support plate has a correspondingly complimentarily angled engagement edge thereon.

8. The tool plate quick securement arrangement for the punch press as recited in claim 5 wherein each generally "J" shaped finger is supported in a generally "J" shaped slot in its respective keeper positioner.

9. The tool plate quick securement arrangement for the punch press as recited in claim 8, wherein a pressure pad is arranged within the generally "J" shaped slot between its generally "J" shaped finger and a wall defining the generally "J" shaped slot.

10. The tool plate quick securement arrangement for the punch press as recited in claim 9, wherein a threaded adjustment member is arranged through the keeper positioner and into abuttable adjustable engagement with the generally "J" shaped finger therewithin.

* * * * *